US010309051B2

(12) United States Patent
Lentz et al.

(10) Patent No.: US 10,309,051 B2
(45) Date of Patent: Jun. 4, 2019

(54) CLOSURE PANEL AND LAUNDRY TREATING APPLIANCE WITH SAME

(71) Applicant: WHIRLPOOL CORPORATION

(72) Inventors: Steven Lentz, Holland, MI (US); Robert Unglenieks, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 3 days.

(21) Appl. No.: 14/948,850

(22) Filed: Nov. 23, 2015

(65) Prior Publication Data

US 2017/0145622 A1 May 25, 2017

(51) Int. Cl.
*D06F 39/00* (2006.01)
*D06F 58/20* (2006.01)
*D06F 39/12* (2006.01)

(52) U.S. Cl.
CPC ..... *D06F 58/20* (2013.01); *D06F 39/001* (2013.01); *D06F 39/12* (2013.01)

(58) Field of Classification Search
CPC ..... D06F 39/14; D06F 39/12; D06F 39/001; D06F 39/125; D06F 58/20; B65D 2585/6855; B65D 19/44; B65D 2585/6857; B65D 2585/6817; A47B 3/0915
USPC ..... 206/320; 229/113, 116; 312/351.5–351.7, 351.1; 220/610, 6, 220/4.28; 248/688, 676, 677, 678, 188.1, 248/188.6, 346.3, 346.5, 346.01, 544, 248/346.03; 108/51.3, 55.1
See application file for complete search history.

(56) References Cited

U.S. PATENT DOCUMENTS 2,783,930 A * 3/1957 Riley ..... B65D 5/5054 206/320
3,297,289 A * 1/1967 La Raus ..... A47G 7/06 206/423
3,365,761 A * 1/1968 Kalvig ..... B25H 3/04 211/65
3,565,244 A * 2/1971 Wakefield ..... B65D 5/3621 206/218
4,019,672 A * 4/1977 Giannini ..... B65D 5/5069 206/320
4,266,716 A * 5/1981 Austin ..... B65D 5/3621 229/116
4,375,261 A * 3/1983 Kitchell ..... B65D 5/5035 206/320
4,466,376 A * 8/1984 Wells ..... B60Q 7/005 116/63 C
4,544,351 A * 10/1985 Marsicano ..... F21V 35/00 206/588
4,726,468 A * 2/1988 Hesser ..... A47G 7/025 206/423
4,819,803 A * 4/1989 Neiser ..... A47G 7/025 206/423
5,056,341 A 10/1991 Mori et al.
(Continued)

FOREIGN PATENT DOCUMENTS

JP 01209097 A 8/1989

*Primary Examiner* — Hiwot E Tefera
(74) *Attorney, Agent, or Firm* — McGarry Bair PC

(57) ABSTRACT

A closure panel and a laundry treating appliance including a cabinet defining an interior and having a bottom opening, a treating chamber located within the interior for receiving an article to be treated and a closure panel mounted within the interior and having a set of flaps configured to cover at least a portion of the bottom opening.

12 Claims, 6 Drawing Sheets

(56) References Cited

U.S. PATENT DOCUMENTS

| | | | | |
|---|---|---|---|---|
| 5,305,951 | A * | 4/1994 | Kuhn | B65D 5/2047 229/105 |
| 5,515,702 | A | 5/1996 | Park | |
| 6,386,437 | B1 * | 5/2002 | Larson, Jr. | B65D 5/3621 229/109 |
| 6,640,517 | B2 * | 11/2003 | Mitchell | E04C 3/34 403/187 |
| 7,014,160 | B2 * | 3/2006 | Muyskens | B65D 5/5035 206/320 |
| 8,074,952 | B2 * | 12/2011 | Baechle | D06F 39/001 108/51.3 |
| 8,505,719 | B2 * | 8/2013 | Rodriguez Sanchez | B65D 85/68 206/320 |
| 8,651,309 | B2 * | 2/2014 | Gualersi | B65D 11/1833 220/4.28 |
| 9,540,158 | B1 * | 1/2017 | Fox | B65D 67/00 |
| 9,670,611 | B2 * | 6/2017 | Senn | D06F 39/001 |
| 2007/0175786 | A1 * | 8/2007 | Nicklas | B21C 47/18 206/395 |
| 2012/0273386 | A1 * | 11/2012 | Miyazaki | B65D 5/12 206/591 |
| 2015/0337479 | A1 * | 11/2015 | Senn | B65D 5/02 206/320 |
| 2017/0197753 | A1 * | 7/2017 | Cram | B65D 19/44 |

* cited by examiner

CLOSURE PANEL AND LAUNDRY TREATING APPLIANCE WITH SAME

BACKGROUND OF THE INVENTION

Contemporary laundry treating appliances, such as clothes washers, may be a common convenience in many homes. In the case of a clothes washer, a user simply loads the cleaning appliance with laundry to be treated into a treating chamber, along with an optional supply of a treating chemistry, such as detergents, bleach, enzymes, and anti-spotting agents, and selects and initiates a cleaning cycle that may be subsequently automatically carried out by the cleaning appliance.

In order to adequately ship a completed clothes washer, support of the wash unit is often required from underneath the unit using packaging materials. This requires a hole in the cabinet that will allow sound to escape during the cleaning cycle, creating customer annoyance.

SUMMARY OF THE INVENTION

In one aspect, an illustrative embodiment relates to a closure panel for a laundry treating appliance having a cabinet with a bottom opening comprising a frame configured to be received within the cabinet and a set of flaps operably coupled to the frame and moveable between a shipping position where the set of flaps is configured to accommodate packaging materials and an installed position where the set of flaps is configured to cover at least a portion of the bottom opening of the laundry treating appliance.

In another aspect, an illustrative embodiment relates to a closure panel for installation in a laundry treating appliance having a cabinet with a bottom opening, comprising a frame configured to be received within the cabinet and factory-installed, a set of flaps mounted to the frame and configured to cover at least a portion of the bottom opening of the laundry treating appliance.

In yet another aspect, an illustrative embodiment relates to a laundry treating appliance, comprising a cabinet defining an interior and having a bottom opening, a treating chamber located within the interior for receiving an article to be treated, and a closure panel mounted within the interior, including a frame and a set of flaps operably coupled to the frame and moveable between a shipping position and an installed position where the set of flaps is configured to cover at least a portion of the bottom opening.

DESCRIPTION OF EMBODIMENTS OF THE INVENTION

Figure 1:
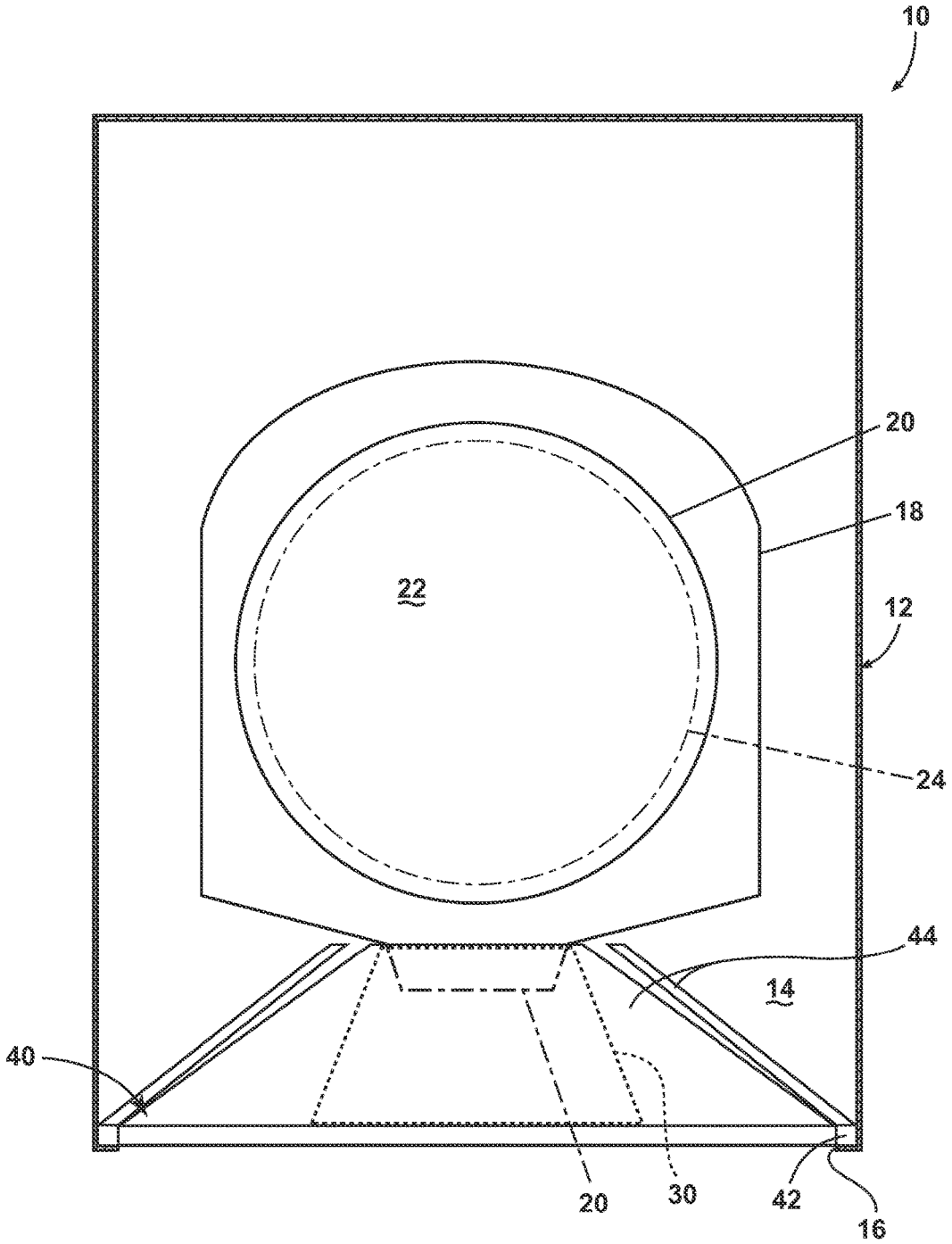
FIG. 1 is a schematic view of a laundry treating appliance in the form of a horizontal axis washer having a closure panel according to an illustrative embodiment in accordance with the present disclosure, which is illustrated in a shipping position.

Referring now to FIG. 1, a first embodiment in accordance with the present disclosure may be illustrated as a laundry treating appliance in the environment of a horizontal axis automatic clothes washing machine 10. Although much of the remainder of this application will focus on the embodiment of an automatic clothes washing machine, the illustrative embodiments may have utility in other environments, including other laundry treating appliances. The automatic clothes washing machine 10 shares many features of a conventional automated clothes washer, which will not be described in detail herein except as necessary for a complete understanding of the illustrative embodiments in accordance with the present disclosure. The embodiment of the present disclosure may also be utilized in other fabric treatment appliances such as a dryer, such as a tumble dryer or a stationary dryer, or a combination washing machine and dryer.

Further, washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. In horizontal axis machines mechanical energy is typically imparted to the clothes by the tumbling action formed by the repeated lifting and dropping of the clothes, which is typically implemented by the rotating drum. Embodiments of the present disclosure may be suitable for use in both horizontal axis and vertical axis automatic clothes washing machines.

A structural support system including a cabinet 12 can define a housing within which a laundry holding system resides. The cabinet 12 can be a housing having a chassis and/or a frame, defining an interior 14 and having a bottom opening 16. The cabinet 12 can house components typically found in a conventional washing machine, such as motors, pumps, fluid lines, controls, sensors, transducers, and the like. Such components will not be described further herein except as necessary for a complete understanding of the illustrative embodiments.

The laundry holding system includes a tub 18 supported within the cabinet 12 by a suitable suspension system (not shown) and a rotatable laundry-container in the form of a drum 20 provided within the tub 18. The drum 20 defines at least a portion of a laundry treating chamber 22 for receiving a laundry load for treatment. In the horizontal axis automatic clothes washing machine 10, the laundry treating chamber 22 is disposed on a horizontal axis. It is within the scope of the present disclosure for the laundry holding system to include only a tub with the tub defining the laundry treating chamber. Regardless the treating chamber is located within the interior 14 defined by the cabinet 12 and may receive an article to be treated. A door 24 (shown in phantom) may be mounted to the cabinet 12 to selectively close an access opening to the interior of the drum 20 and/or tub 18.

In order to adequately ship the washing machine 10, support of the tub 18 is often required from underneath the washing machine using packaging materials. Exemplary packing materials are illustrated in phantom at 30. The bottom opening 16 allows for the packing materials 30 to be removed after shipping. During operation of the appliance, the bottom opening 16 allows sound to escape, which creates customer annoyance. While foam strips can be added to the underside of the cabinet 12 to contact the floor during machine installation, these strips may be damaged during packaging, shipping, or installation. Alternately, a customer-installed panel or customer-installed foam strips are available, but these add-on components may be improperly installed or forgotten. To alleviate the sound escaping from the bottom opening, the washing machine 10 is illustrated as including a factory-installed closure panel 40.

The closure panel 40 can be mounted within the interior 14 and installed at the bottom of the cabinet 12 at the factory. A frame 42 can be included as a portion of the closure panel 40 and the frame 42 can be shaped in any suitable manner including that it can be configured to fit on top of a lower portion of a chassis of the cabinet 12 or can be mounted to the chassis or cabinet 12 in any suitable manner. It is contemplated that the frame 42 can be formed from any suitable material including, but not limited to, that it can include a stamped metal piece. It is alternatively possible for the frame to be a portion of the cabinet or other portion of the clothes washing machine 10.

A set of flaps 44 is illustrated as being included in the closure panel 40. The set of flaps 44 can be operably coupled to the frame 42 or the set of flaps 44 can be coupled to a portion of the clothes washing machine 10 including, but not limited to, the cabinet 12. It will be understood that the closure panel 40 may not include the separate frame portion or that the frame can be integral with the set of flaps. Regardless, the set of flaps 44 can be operably coupled to a bottom portion of the cabinet 12 at the factory. It will be understood that "a set" can include any number of flaps 44, including only one flap 44. In the illustrated example, the set of flaps 44 has been illustrated as including multiple flaps 44.

Figure 2:
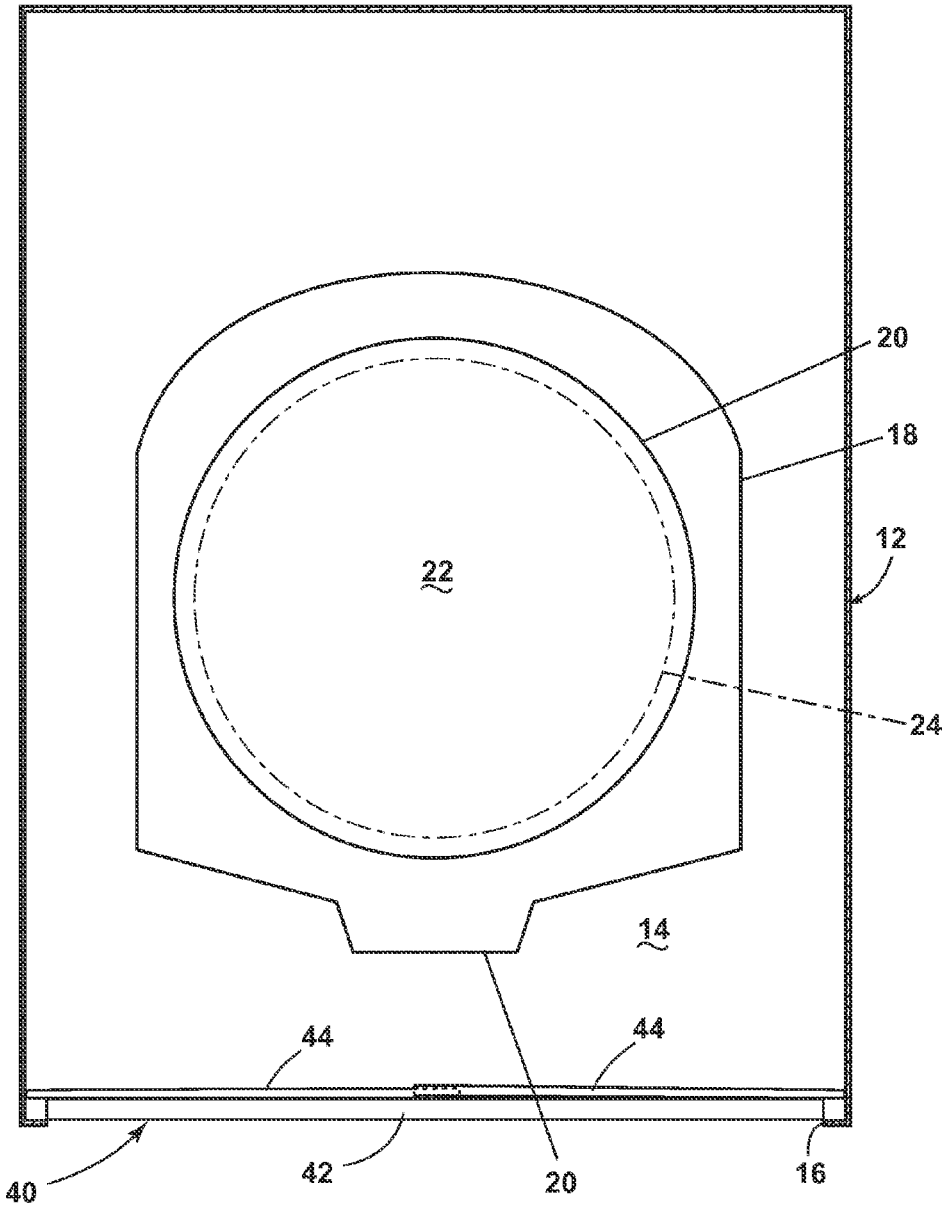
FIG. 2 is a schematic view of the laundry treating appliance of FIG. 1 with the closure in an installed position.

Because the closure panel 40 is factory installed it must be able to accommodate the packing materials 30. In this manner, the set of flaps 44 are moveable between a shipping position (FIG. 1) where the set of flaps 44 is held open by the packaging material 30 and an installed position (FIG. 2) where the set of flaps 44 is configured to cover at least a portion of the bottom opening 16. More specifically, when the packaging material 30 is removed, the set of flaps 44 can fall into place in a substantially flat orientation to seal at least portions of the bottom opening 16. Such a closure panel 40 is less likely to be damaged during installation than existing solutions.

Figure 3A:
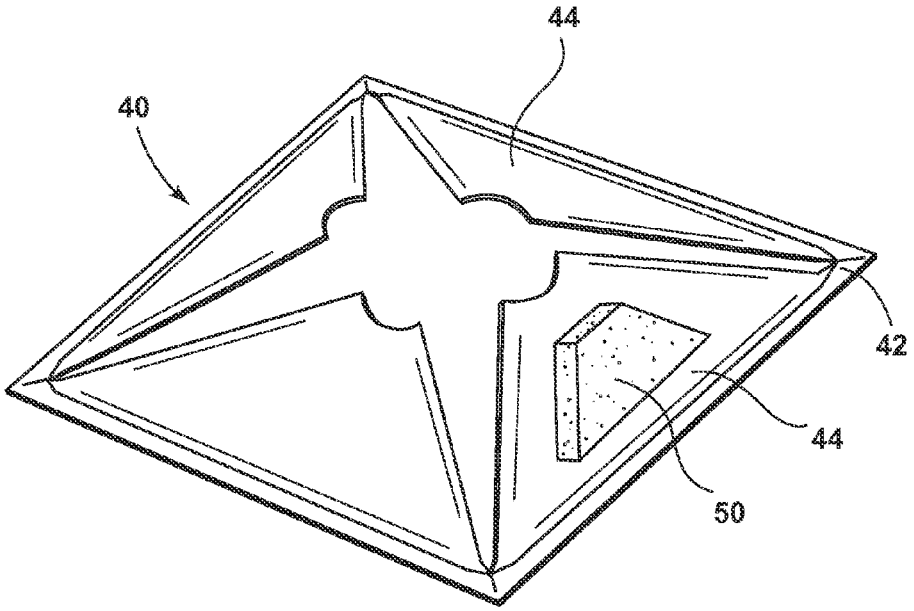
FIG. 3A is a perspective view of the closure panel illustrated in FIG. 1 in the shipping position.

FIG. 3A is a perspective view of the closure panel 40 removed from the automatic clothes washing machine 10. The closure panel 40 is illustrated in the shipping position; however, the packaging material 30 is not shown for the sake of clarity. Also illustrated is an optional sound absorbing pad or sound proofing segment 50. It is contemplated that one or more sound proofing segments 50 can be operably coupled to the set of flaps 44. In the illustrated example, a sound proofing segment 50 has been illustrated as being mounted to one of the multiple flaps 44. It will be understood that any number of sound proofing segment(s) 50 can be utilized including, but not limited to, that a sound proofing segment 50 can be included on each of the multiple flaps 44, some of the multiple flaps 44, or none of the set of flaps 44. Further, multiple sound proofing segments 50 can be utilized on a single flap 44. Such sound proofing segments 50 can be shaped in any suitable manner including, but not limited to, that the sound proofing segments 50 can be of any suitable shape, size, and thickness including that the sound proofing segment 50 can be formed from multiple layers. Further, the sound proofing segments 50 can be formed from any suitable material including foam, fiber materials, etc. Further, the sound proofing segment(s) can be operably coupled or otherwise mounted to the set of flaps 44 in any suitable manner including via adhesive or other fasteners. In this manner, it will be understood that the closure panel 40 allows for the addition of sound proofing materials if more is desired.

Figure 3B:
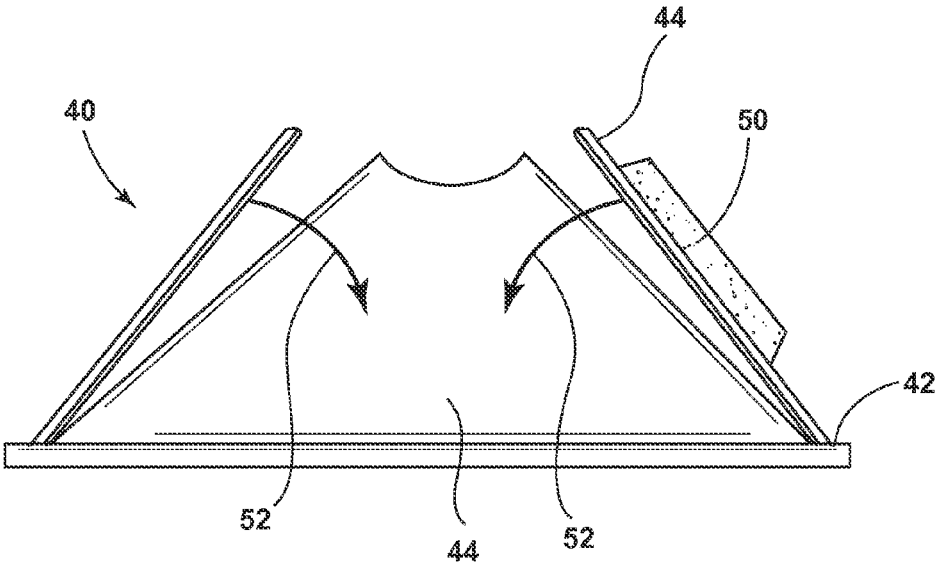
FIG. 3B is a side view of the closure panel illustrated in FIG. 1 in the shipping position.

FIG. 3B also shows the set of flaps 44 in a shipping position, where they are held open during transport by the packaging materials (not shown). Such flaps 44 can be formed in any suitable manner including that the set of flaps 44 can include flaps that are configured to fall into a substantially flat position (as illustrated by arrows 52) when not held open by the packaging material.

The set of flaps 44 can be formed from any suitable material including but not limited to, foam, fiber materials including natural and man-made fibers or a combination thereof. By way of further example, cotton, polyester, polypropylene, jute, kenaf, etc. can be utilized to form a fiber panel. Further still a blend of materials including foam and fiber materials can be utilized.

Figure 4A:
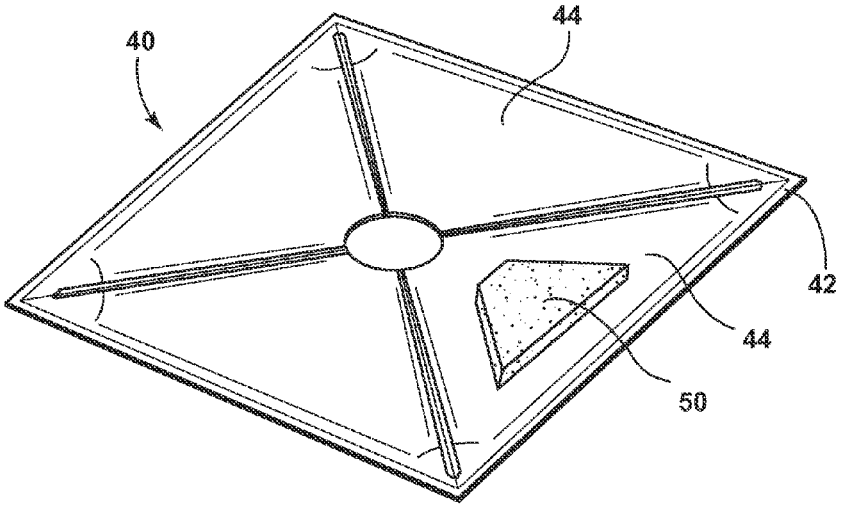
FIG. 4A is a perspective view of the closure panel illustrated in FIG. 1 in the installed position.

Depending on the material(s) used, it is contemplated that the set of flaps 44 can be molded. In particular, the edges of the multiple flaps 44 can be molded such that they fall into an overlapping flat position upon installation to seal or partially close the opening 16 at the bottom of the cabinet 12. In this manner, when the set of flaps are in the installed position (FIG. 4A) at least a portion of the set of flaps 44 overlap to provide better sealing and sound proofing. Further, while, the set of flaps 44 is illustrated as covering only a portion of the bottom opening 16 of the cabinet 12 it will be understood that the set of flaps 44 in the installed position can be configured to cover an entirety of the bottom opening 16.

Figure 4B:
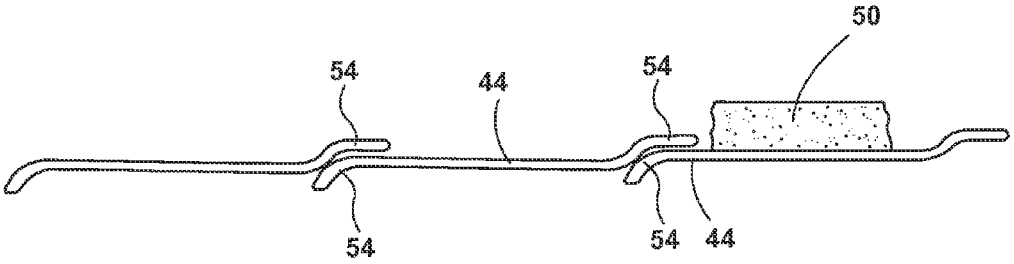
FIG. 4B is a side view of a portion of the closure panel illustrated in FIG. 1 in the installed position.

FIG. 4B illustrates more clearly that at least a portion of the multiple flaps 44 can overlap in the installed position. More specifically, the edges 54 are illustrated as overlapping. In this manner, the set of flaps 44 can overlap in a substantially flat position upon removal of the packaging materials to seal or partially close the opening 16 at the bottom of the cabinet 12.

Figure 5A:
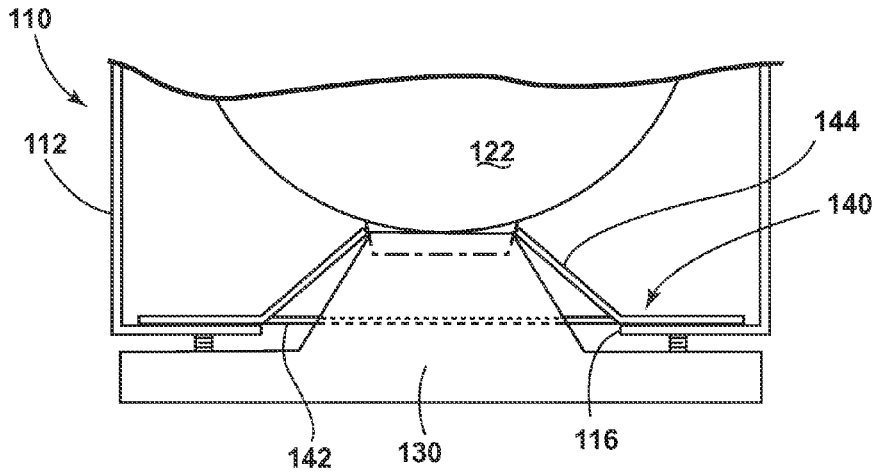
FIG. 5A is a schematic view of another embodiment of a laundry treating appliance in the form of a vertical axis washer having a closure panel according to an illustrative embodiment in accordance with the present disclosure, and which is illustrated in a shipping position.

Referring now to FIG. 5A, another embodiment includes a closure panel 140 in the environment of a laundry treating appliance in the form of a vertical axis automatic clothes washing machine 110. The second embodiment is similar to the first embodiment; therefore, like parts will be identified with like numerals increased by 100, with it being understood that the description of the like parts of the first embodiment applies to the second embodiment, unless otherwise noted.

The automatic clothes washing machine 110 has a treating chamber 122 disposed on a vertical axis. The automatic clothes washing machine 110 also includes a cabinet 112 enclosing components typically found in a conventional washing machine, such as motors, pumps, fluid lines, controls, sensors, transducers, and the like (not shown). The closure panel 140 may be configured differently, from the closure panel described above, to accommodate the location of such components. More specifically, a motor or pump (not shown) of the automatic clothes washing machine 110 may be located in a lower portion of the cabinet 112.

As with the previously described closure panel, the closure panel 140 includes a set of flaps 144, which are moveable between a shipping position (FIG. 5A) where the set of flaps 144 is configured to accommodate packaging materials 130 and an installed position where the set of flaps 144 is configured to cover at least a portion of the bottom opening 116 of the clothes washing machine 110.

Figure 5B:
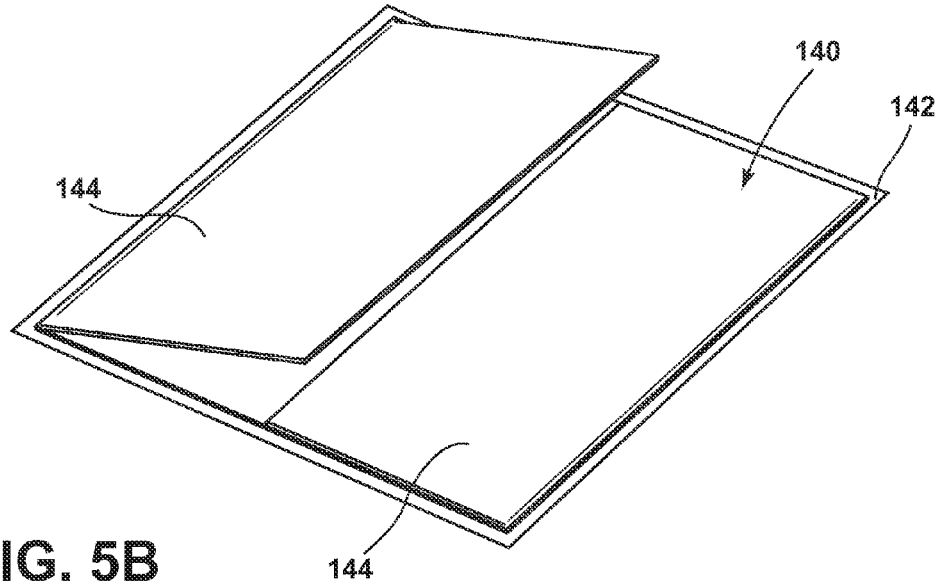
FIG. 5B is a perspective view of the closure panel illustrated in FIG. 5A in a partially installed position.

As better seen in the partially installed position of FIG. 5B, the closure panel 140 includes two flaps 144 supported by a frame 142, which can be installed in the cabinet 112. It is contemplated that both flaps 144 may be moveable between the shipping and installed positions. Alternatively, if the packaging materials can be sufficiently accommodated, only one of the set of flaps 144 may be moveable and the other may remain in the flat position. As with the previously described embodiments the set of flaps 144 can alternatively be directly mounted to the cabinet 112 without the need for a frame 142.

Figure 6A:
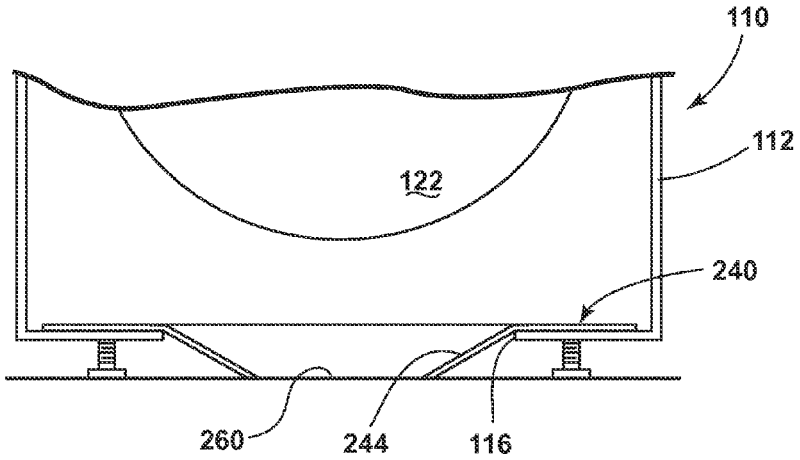
FIG. 6A is a schematic view of another embodiment of a closure panel in the laundry treating appliance of FIG. 5A.

Referring now to FIG. 6A, yet another exemplary illustration of a closure panel 240 is illustrated in the environment of the vertical axis automatic clothes washing machine 110. The third embodiment of the closure panel 240 is similar to the second embodiment 140; therefore, like parts will be identified with like numerals increased by 100, with it being understood that the description of the like parts of the second embodiment applies to the third embodiment, unless otherwise noted.

One difference is that a frame is not included in the closure panel 240. Instead, each flap 244 has been illustrated as including a first portion 270 that is mounted to the cabinet 112 and a second moveable portion 272 that can lower and rise to accommodate any suitable packaging materials. Such second moveable portions 272 can then fall or otherwise be located in the installed position (shown). While the closure panel 240 has been illustrated as being mounted to an interior surface of the cabinet 112, it is also contemplated that the closure panel 240 can be mounted to an external surface of the cabinet 112.

Figure 6B:
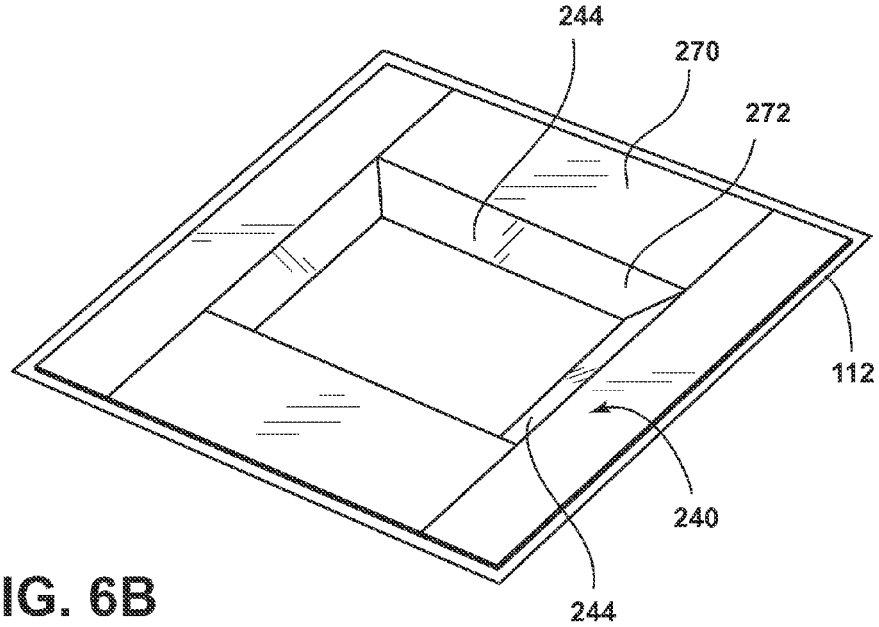
FIG. 6B is a perspective view of the closure panel illustrated in FIG. 6A in the installed position.

Another difference is that the set of flaps 244, when in the installed position, can be configured to contact a surface or floor 260 on which the cabinet 112 is supported. In this manner, the set of flaps 244, when they are in the installed position, are configured to cover at least a portion of the bottom opening 116 of the clothes washing machine 110 and are configured to touch the floor 260. This can be particularly useful in vertical axis automatic clothes washing machine 110, which can have a pump or motor located in a central lower portion of the cabinet 112. As shown in FIG. 6B, the multiple flaps forming the set of flaps 244 need not be the same shape or size. Although this need not be the case, in the illustrated example two short flaps and two long flaps are included. The set of flaps can still include multiple flaps that are molded such that the edges of the molded flaps fall into an overlapping manner. In the illustrated example, the edges of the second moveable portions 272 of the flaps 244 abut each other and sound is directed towards the floor 260 by the set of flaps 244.

The various aspects described herein provide a variety of benefits including that sound from the appliance can be attenuated. Further, such closure panels are factory installed and less likely to be damaged during installation than existing solutions, which require a user to install them. Furthermore, additional sound proofing material can be included on the closure panel if more is desired. It will also be understood that for all of the embodiments previously described that only some of the illustrated set of flaps may be provided. For example, a rear most flap may not be provided to accommodate components such as recirculation conduits, pumps, motors, etc. In such instances the closure panel may not cover the entire bottom opening or may not include flaps extending from all sides of the frame. Regardless, the closure panel will still provide improved sound attenuation.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While illustrative embodiments in accordance with the present disclosure may have been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance configured to treat laundry according to an automatic cycle of operation, comprising:

a cabinet defining an interior and having a bottom opening;

a treating chamber located within the interior for receiving an article to be treated; and a closure panel mounted to a lower portion of the cabinet within the interior of the cabinet, the closure panel comprising a set of moveable flaps adapted to selectively move between a shipping position where at least one of the set of moveable flaps is oriented to accommodate packaging material and an installed position where the set of moveable flaps is configured to cover at least a portion of the bottom opening during the automatic cycle of operation;

wherein the set of moveable flaps are configured to fall from the shipping position to the installed position when not held open by the packaging material while being mounted to the lower portion of the cabinet and within the interior of the cabinet.

2. The laundry treating appliance of claim 1 wherein the cabinet includes a chassis and the closure panel is sized to rest on top of a lower portion of the chassis and be mounted to the chassis.

3. The laundry treating appliance of claim 1 wherein the set of moveable flaps comprises multiple substantially triangular flaps.

4. The laundry treating appliance of claim 1 wherein the set of moveable flaps comprise multiple flaps and at least a portion of the multiple flaps overlap in the installed position.

5. The laundry treating appliance of claim 4, further comprising a sound proofing segment operably coupled to one of the multiple flaps.

6. The laundry treating appliance of claim 5 wherein the set of moveable flaps in the shipping position are configured to be held open by packaging materials.

7. The laundry treating appliance of claim 1 wherein the set of moveable flaps is formed from molded foam.

8. The laundry treating appliance of claim 1 wherein the set of moveable flaps is formed from fiber material.

9. The laundry treating appliance of claim 1, further comprising a frame to which the set of moveable flaps are operably coupled.

10. The laundry treating appliance of claim 1 wherein the set of moveable flaps in the installed position are configured to cover an entirety of the bottom opening.

11. The laundry treating appliance of claim 1 wherein the set of moveable flaps in the installed position are configured to contact a surface on which the cabinet is supported.

12. The laundry treating appliance of claim 1 wherein the treating chamber is disposed on one of a horizontal axis or a vertical axis.

* * * * *